United States Patent [19]

Bianchi et al.

[11] 4,048,965

[45] Sept. 20, 1977

[54] APPARATUS FOR DETERMINING THE FUEL INJECTION QUANTITY IN MIXTURE COMPRESSING INTERNAL COMBUSTION ENGINES

[75] Inventors: Valerio Bianchi, Hochdorf; Reinhard Latsch, Vaihingen; Peter Schmidt, Schwieberdingen, all of Germany

[73] Assignee: Robert Bosch GmbH, Stuttgart, Germany

[21] Appl. No.: 638,267

[22] Filed: Dec. 5, 1975

[30] Foreign Application Priority Data

Dec. 5, 1974 Germany ..... 2457461

[51] Int. Cl.[2] ..... F02D 5/00

[52] U.S. Cl. ..... 123/32 EA

[58] Field of Search ..... 123/32 EA; 235/150.21

[56] References Cited

U.S. PATENT DOCUMENTS

| | | | |
|---|---|---|---|
| 3,862,404 | 1/1975 | Fiedrich | 123/32 EA X |
| 3,903,857 | 9/1975 | Honig et al. | 123/117 R |
| 3,935,846 | 2/1976 | Zelenka | 123/32 EA X |

*Primary Examiner*—Alan Cohan
*Assistant Examiner*—Gerald A. Michalsky
*Attorney, Agent, or Firm*—Edwin E. Greigg

[57] ABSTRACT

A fuel metering system of an internal combustion engine is controlled by a digital computer circuit which delivers injection pulses to actuate the fuel injection valve of the engine. The duration of these pulses is directly related to the amount of injected fuel and depends on the inherent characteristics of the engine as well as on the engine r.p.m. and the degree of throttle opening. A set of data points each of which correlates a fuel datum with a pair of numbers related to engine speed and throttle valve opening, respectively, is stored in a digital memory and can be addressed by digital signals from transducers associated with engine speed and throttle valve position. An arithmetic unit then performs an interpolation process by weighted addition of nearest neighbor values of the datum stored in the memory. The final, interpolated datum is counted down at constant or variable frequency and represents an output signal related to the fuel injection period.

13 Claims, 7 Drawing Figures

Fig. 2
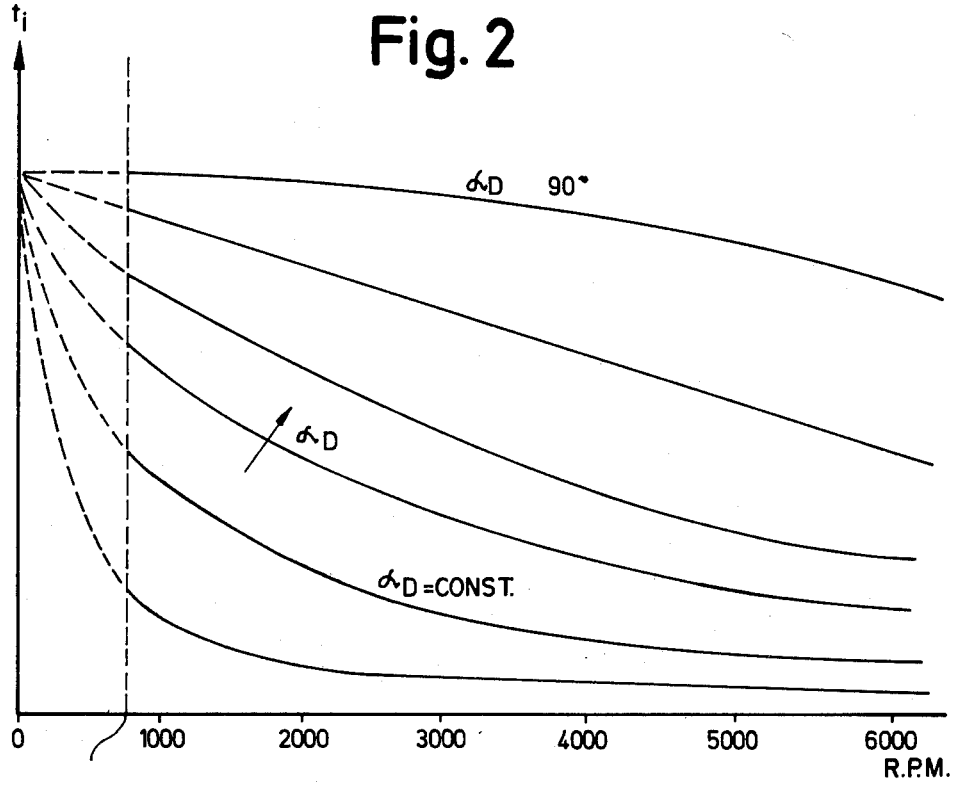
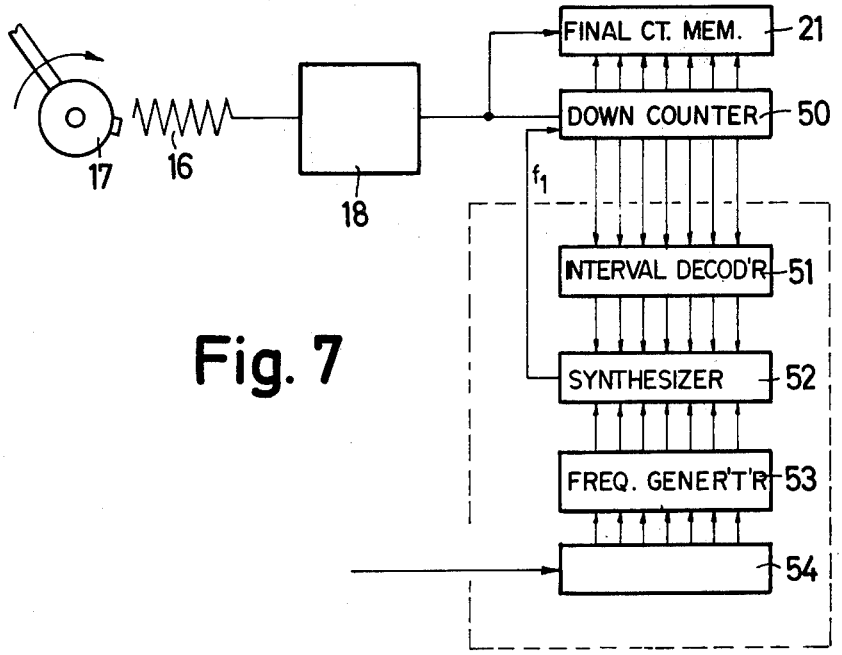
Fig. 7

$$A = \bar{a}\bar{b}\bar{c}\bar{z}$$
$$B = \bar{a}\bar{b}\bar{c}z \vee \bar{a}\bar{b}c\bar{z}$$
$$C = \bar{a}\bar{b}cz \vee \bar{a}b\bar{c}\bar{z}$$
$$D = \bar{a}b\bar{c}z \vee \bar{a}bc\bar{z}$$
$$E = \bar{a}bcz \vee a\bar{b}\bar{c}\bar{z}$$
$$F = a\bar{b}\bar{c}z \vee a\bar{b}c\bar{z}$$
$$G = a\bar{b}cz \vee ab\bar{c}\bar{z}$$
$$H = ab\bar{c}z \vee abc\bar{z}$$

APPARATUS FOR DETERMINING THE FUEL INJECTION QUANTITY IN MIXTURE COMPRESSING INTERNAL COMBUSTION ENGINES

BACKGROUND OF THE INVENTION

The invention relates to an apparatus for determining the fuel injection quantity, the angle of ignition dwell, the exhaust gas recycle rate or similar parameters, in mixture compressing internal combustion engines. The invention relates to engines in which the injected fuel is supplied to combustion chambers of cylinders by injection valves which operate in dependence on the throttle valve position and on the r.p.m. of the engine. A set of characteristic curves of the duration of fuel injection as a function of r.p.m. with the throttle valve position as a variable parameter is provided for any particular type of internal combustion engine in a digitally coded computer circuit. The instantaneous values of the engine r.p.m. and of the throttle valve position are also digitally coded and are supplied to the computer circuit. The computer circuit includes a memory with a predetermined number of storage cells from which the circuit is able to derive the appropriate fuel injection duration based on the instantaneous values of r.p.m. and throttle valve position.

Mixture compressing internal combustion engines must be supplied with the proper amount of fuel corresponding to the aspirated air quantity for each power stroke of the engine. The amount of fuel must be such that the combustion produces adequate power but operates without an excess of fuel since that would result in an intolerably high degree of toxic components.

For these reasons, it is desired to supply a combustion fuel-air mixture which is either at the stoichiometric ratio, where the air number $\lambda$ is equal to 1 or lies in a region in which there is excess air; the latter condition is particularly suitable to reduce toxic exhaust gas components up to a certain limit so as to permit compliance with the evermore rigorous requirements with respect to atmospheric purity. Only during full-load operation (fully open throttle valve) is it necessary to operate the engine with air numbers where $\lambda$ is less than 1. However, in order to correctly adjust the duration of fuel injection, for example when the fuel is supplied to the cylinders or to the induction tube via injection valves, it is necessary to know the aspirated air quantity exactly. This knowledge may be derived from measurement of the air flow rate in the induction tube of the engine, for example by means of a baffle plate which is displaced against a restoring force and serves to adjust appropriate metering means coupled thereto. Unfortunately, this is a relatively expensive process which, furthermore, suffers from the inherent disadvantage that when the throttle is opened, the increase of the engine torque is delayed due to the delay between the increased aspirated air quantity with regard to the newly set throttle valve position.

Instead of making an air flow rate measurement, it is also possible to fix the fuel injection duration on the basis of the engine r.p.m. and the induction tube pressure. By following the characteristic curve of an induction tube pressure sensor, the correct amount of fuel as a function of induction tube pressure for a particular r.p.m. may be determined.

Induction tube pressure measurements are however also quite complicated and, just as in the baffle plate measurement, additional sensors are required. Furthermore, as in the air flow rate measurement, there is a delay in the occurrence of the torque increase. A supplementary mechanism is required to achieve a temporary enrichment during a change of the throttle valve position so as to obtain a good transition from one state to the next.

It is also known to determine the fuel quantity supplied to the combustion chambers in the cylinder, i.e., to determine the injection time when using injection valves supplied with fuel at a certain pressure from the instantaneous values of the throttle valve position and the r.p.m. These two values alone are suitable to make an unambiguous determination of the fuel quantity to be injected.

However, this method requires to have available a so-called set of characteristic curves for each and every type of engine which is to be supplied with fuel. This set of characteristic curves shows the dependence of the fuel quantity to be injected or of the injection duration $t_i$ as a function of the r.p.m., with the common parameter being the throttle valve position. A known characteristic set of curves for a process of this type is shown schematically in FIG. 2 and will be discussed in more detail below. When mechanical injection systems are used, the solution involves a three-dimensional cam which determines the fuel quantity to be injected on the basis of the prevailing values of the r.p.m. and the throttle valve position. As may be seen from the curves in FIG. 2, the fuel injection quantity depends in a relatively complicated manner on the r.p.m. and the throttle valve position. For this reason, it has heretofore been regarded as impossible to simulate the function which defines the injected fuel quantity with any reasonable amount of effort and expenditure in an electrical or electronic injection system. In the function $t_i = f(\alpha, n)$ shown in FIG. 2, $t_i$ is the time during which fuel is injected to a cylinder per power stroke and is therefore proportional to the fuel quantity Q. $\alpha$ is the instantaneous position of the throttle valve and n is the instantaneous r.p.m. Since the above-mentioned function f is difficult to follow in a direct manner, a known circuit uses a low pass filter and a pulse shaping circuit to transform this function into a somewhat simpler function which is easier to follow, and this simpler function is subsequently multiplied or modulated by another r.p.m.-dependent function. This known method also entails a substantial expense.

OBJECT AND SUMMARY OF THE INVENTION

It is a principal object of the invention to provide an apparatus for determining, in electrical manner, the correct fuel injection quantity for mixture-compressing internal combustion engines. The apparatus computes the fuel injection quantity to be injected from the throttle valve position and from the r.p.m. of the particular internal combustion engine in which it is used. When the set of characteristic curves for the particular engine is known, the apparatus is capable to derive therefrom the correct injection time. A supplementary superimposed control process may be used in a preferred embodiment to regulate the injection time with high precision.

This object is attained by the invention in an apparatus of the type described above by providing a digital computer circuit which contains a memory in which are stored the data corresponding to the characteristic curves of the engine. The instantaneous values of the throttle valve position $\alpha$ and of the r.p.m. are obtained in digital form, and the most significant bits (MSB) of each of these values are fed to the memory for defining an interpolation interval while the less significant bits (LSB) are interpolated by averaging. An apparatus of this type is particularly capable of being used, in a further feature of the invention, as part of a complete control system in which the actual behavior of the controlled engine is determined by sensing, for example, its smooth running or its exhaust gas composition (air number $\lambda$) and by deriving signals from these parameters which can be used as feedback signals and are fed to the computer circuits in the proper sense so that the engine can be operated and controlled in a very precise manner. This possibility of controlling an internal combustion engine, in which the particular fuel injection duration is not merely controlled forward according to certain predetermined data is particularly advantageous and also described in the co-pending application Ser. No. 638,021 filed on Dec. 5, 1975. Thus the present invention may be regarded as a particular improvement of the control system described in the above-cited application. The present application is therefore to be regarded as complementary to the above-mentioned application.

The principle of feedback control, which is disclosed in the above-mentioned co-pending application in great detail, is now described in a general manner. The apparatus may be controlled with very high precision by providing that the mechanism which controls the injection period receives feedback signals which relate, for example, to the smooth running of the engine. The smooth running of the engine may be determined with an appropriate transducer which provides pulses due to crankshaft rotation, preferably inductively. Engine roughness is characterized by an angular deviation of the crankshaft position. These phase shifts are sensed and are transformed into appropriate smoothness signals. Alternatively, it is possible to derive signals from the exhaust gas composition by sensors located in the exhaust system of the engine and thus to determine the fuel-air mixture actually fed to the combustion chambers, i.e., to determine the air number $\lambda$. In that case, signals related to the air number $\lambda$ must be fed to the computer circuit so that the engine may be operated at a stoichiometric fuel-air ratio, preferably however in a region of leaned-out mixture, where $\lambda$ is greater than 1.

It has already been mentioned that the computer circuit which determines the fuel injection duration must contain the particular set of characteristic curves for the engine in which it is used. Therefore, according to the invention, the computer circuit contains a digital memory. According to an embodiment of the invention, this memory does not contain every conceivable point in the set of characteristic curves, because this would involve too great an expense. Only a finite member of predetermined data points is stored in the memory and an interpolation is made among the stored values, as will be explained in greater detail below. In addition to finding the correct injection duration $t_i$, the exact ignition point $t_z$ and the exhaust gas recycle rate AR may also be determined.

Another advantage is that, when this apparatus is associated with an overall control system, the size of the memory can be kept very small because the digital interpolation process used permits increased precision and the fuel injection quantity needs to be specified only approximately by the computer, corresponding to a relatively coarse precontrol. This is possible because the feedback control circuit acts to obtain the higher precision. The computer circuit to be described below can, at the same time, define the ignition time and the exhaust gas recycle rate with the same input data of r.p.m. and throttle valve position.

Another advantage is the usage of simple transducers. The engine r.p.m. is sensed by a crankshaft indicator and the rotational period is determined by a counter, while the throttle valve position $\alpha$ is transduced by a preferably digitally coded throttle valve switch.

If smooth running control is used within the overall control system of the engine, then the required r.p.m. signal may also be taken from the transducers which are in any case required for such control.

The invention will be better understood as well as further objects and advantages thereof become more apparent from the ensuing detailed specification of a preferred exemplary embodiment taken in conjunction with the drawing.

BRIEF DESCRIPTION OF THE DRAWING

FIG. 2 is a set of characteristic curves;

FIG. 7 is a schematic diagram of an apparatus for achieving an improved count of the injection period when using a digital r.p.m. signal.

DESCRIPTION OF THE PREFERRRED EMBODIMENT

Figure 1:
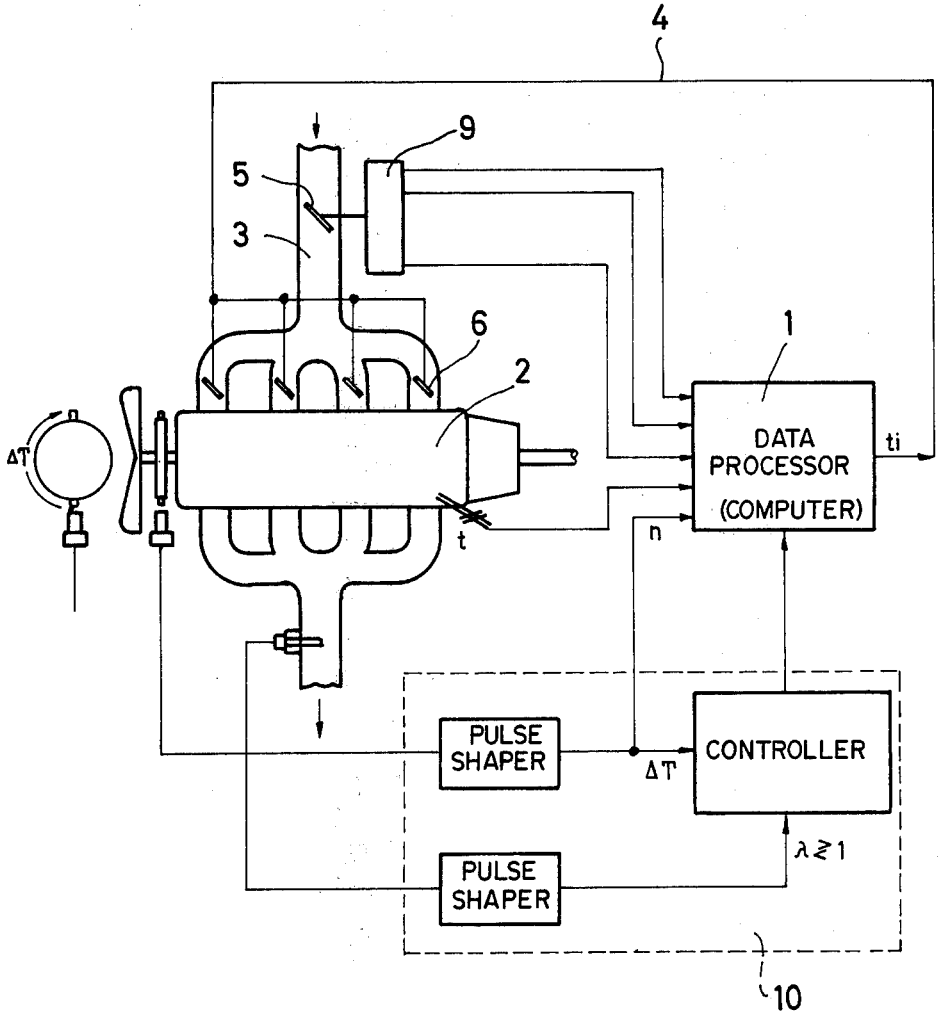
FIG. 1 is a schematic overall representation of an internal combustion engine with associated electronic elements which form a control loop.

The overall diagram of FIG. 1 serves merely for a better understanding of the invention and to elucidate the manner in which the invention is correlated with an overall control system for the engine. In FIG. 1, the computer circuit, according to the invention, has the numeral 1 and the engine which is to be supplied with the correct injection control signals is designated with the numeral 2. The induction tube 3 of the internal combustion engine includes a throttle valve 5 whose positions are transduced by a suitable mechanism 9 and the preferably digitally coded signals are fed to the computer 1. The output control signals of the computer 1 travel via the line 4 to injection valves 6, shown schematically to be located in the branches of the induction manifold. Associated with the computer circuit 1 is a feedback system, generally designated by the numeral 10, which provides to the computer suitably prepared signals related to the engine operation as described above. This feedback system need not be explained in detail in this context, but a detailed explanation thereof may be found in the above-cited co-pending application.

FIG. 2 displays a set of characteristic curves and shows the injection period $t_i$ per power sroke (i.e., the injection quantity) plotted along the ordinate in dependence on the r.p.m. *n.* Each curve in this family of curves is associated with a particular constant throttle valve position $\alpha$. It may be seen in general from this set of curves that, at low r.p.m., a relatively small change in the throttle valve position results in a relatively large change of the injected fuel quantity whereas, at high r.p.m. large throttle valve changes are required to deliver sufficient fuel to the engine.

It is a feature of the present invention that this set of characteristic curves, which is specific to each and every internal combustion engine, is stored in a special memory of the computer circuit so that the completed computer circuit containing this memory is suitable only to provide injection control signals for this particular type of engine. A change of signals may however be performed by exchanging the memory.

Figure 3:
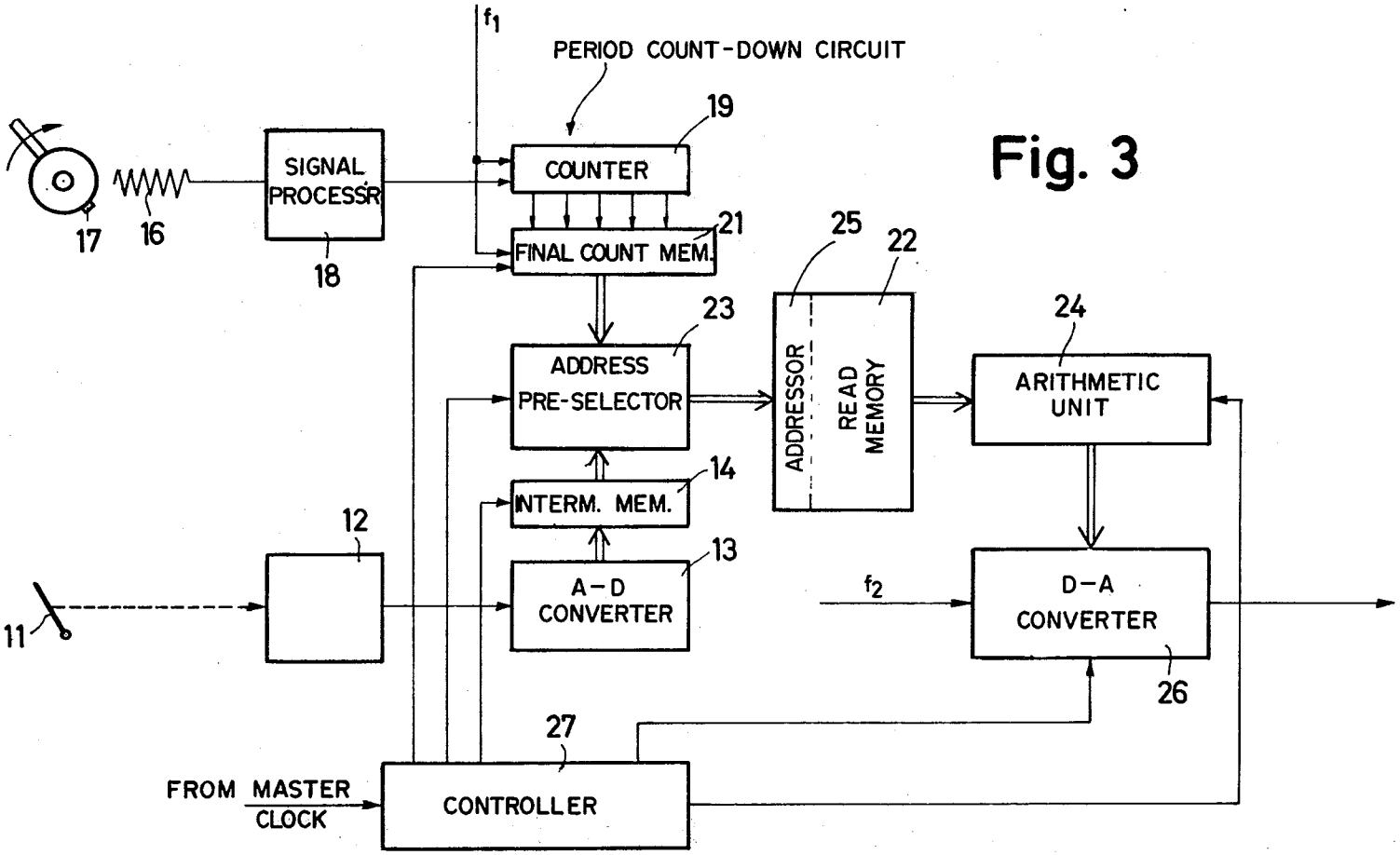
FIG. 3 is a schematic block diagram of the circuit of the computer shown in FIG. 1.

The computer circuit is shown in a schematic representation in FIG. 3 in which the position of the throttle valve 11 is transformed in a converter 13 which generates a binary number related to the position $\alpha$. In the exemplary embodiment, the binary number is preferably a 5-bit word. It would also be possible to embody the throttle valve position transducer 12 as a digital encoder.

From the analog-to-digital converter, the 5-bit word containing the information about the throttle position $\alpha$ is fed to an intermediate storage 14.

In a similar manner, a 5-bit word proportional to r.p.m. or rotational period is obtained. In the exemplary embodiment shown, this is accomplished by means of an inductive transducer 16 which senses the passage of a marker 17 fastened on the crankshaft of the engine. The transducer signal is treated in a signal processing device 18 and is fed to a counter 19 which accepts pulses of constant frequency $f_1$ for the duration of the rotational period. At the end of the count, the appropriate 5-bit word is present in a final count memory 21. By counting the pulses at a constant frequency during the period from one transducer signal to the next, one obtains as a final count a number related to the period. However, if the clock frequency changes according to a hyperbolic function, as will be further discussed below, then the final count represents the r.p.m. Thus, both the intermediate memory 14, as well as the final memory 21, each contains a 5-bit word which is proportional to the throttle valve position and to the r.p.m. or the period, respectively. The numerical values of the 5-bit word stored in the intermediate memory and in the final memory then change whenever the input magnitudes change, i.e., during each crankshaft revolution, the 5-bit word in the final counter 21, which is proportional to the period, is usually changed, and the 5-bit word in the intermediate memory 14 changes when the throttle valve position is changed.

As may be seen from FIG. 3, the apparatus further contains a read-only memory 22 which contains the set of characteristic curves illustrated in FIG. 2 in a specially coded manner. In order to explain this matter more clearly, it is necessary to consider the representation of FIG. 4 and the explanation of the circuit diagram of FIG. 3 will then be continued below.

Figure 4:
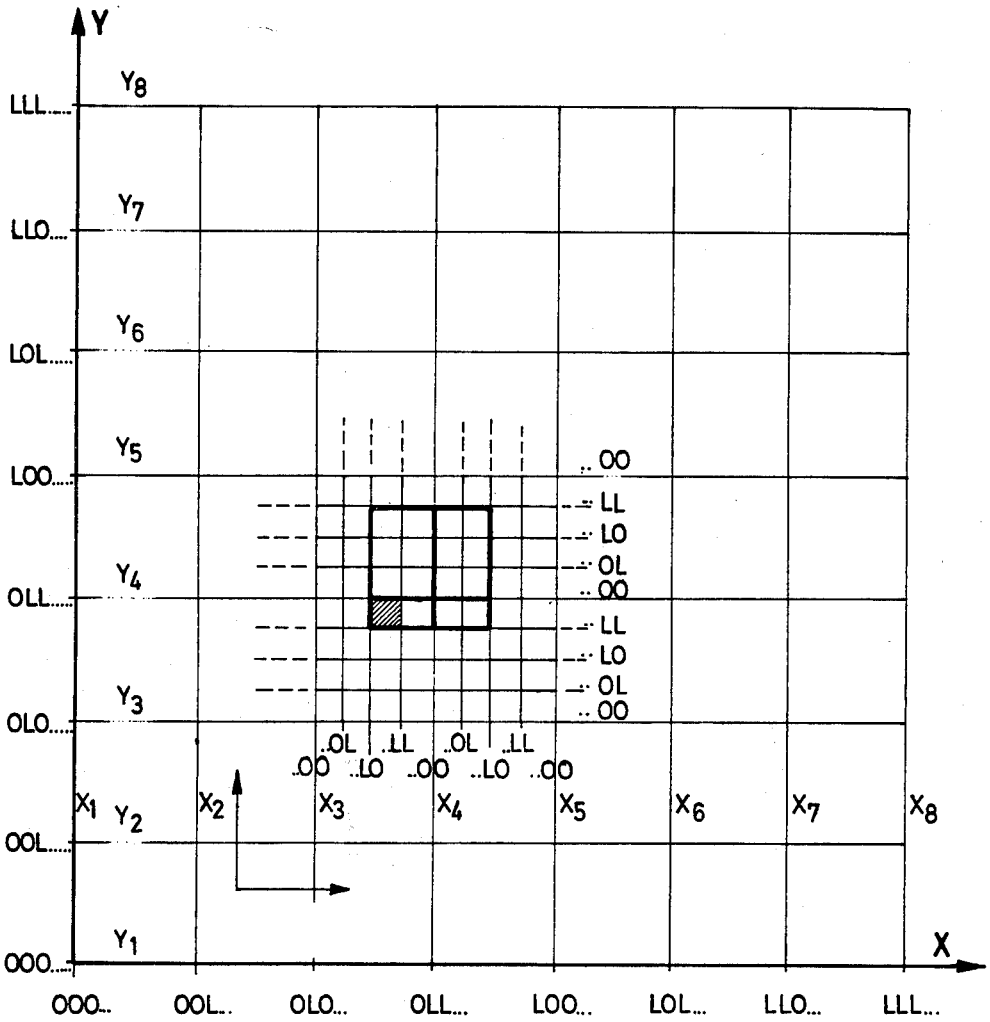
FIG. 4 is a diagram of one embodiment of a memory unit associated with the computer with an indication as to the method of interpolating between discrete stored values of the characteristic curves of FIG. 2.

According to a preferred exemplary embodiment of the invention, the read-only memory 22 is embodied in such a manner that, according to the representation of FIG. 4, the entire set of characteristic curves of FIG. 2 is sub-divided into seven intervals in both the X and Y directions. These directions correspond, for example, to the period T and to the throttle valve position $\alpha$, respectively, so that the read-only memory 22 contains $8 \times 8$ words each having preferably 8 bits. In principle, the number of bits of each of the stored $8 \times 8$ words is arbitrary and it is merely required to have a sufficient number of bits to achieve a sufficient precision. In the exemplary embodiment, the input word has 5 bits and the input to the read-only memory has 3 bits (giving 8 words) and the interpolation takes place using 2 bits (i.e., 4 interpolation steps). Thus, the memory in FIG. 4 is constructed relatively simply but, since it is unlikely that the 5-bit words which correspond to the throttle valve position $\alpha$ and to the period T exactly equal any of the $8 \times 8$ words stored in the memory, an interpolation process is performed in which the 7 intervals are each sub-divided into 4 interpolation steps.

The representation of FIG. 4 is intended to facilitate the explanation of the interpolation process. The embodiment of a circuit for carrying out this process will then be explained with the aid of FIGS. 3 and 5. Turning now to FIG. 4, the ordinate may be identified, for example with the throttle valve position $\alpha$ and the abcissa X may be identified with the period T, so that 5-bit words corresponding to throttle valve position $\alpha$ will be plotted along the Y direction and 5-bit words corresponding to the period T will be plotted in the X direction. The first 3 bits of each 5-bit word plotted along the axes, i.e., the three most significant bits, henceforth referred to as MSB, designate the interval on the axis while the last 2 bits (least significant bits) henceforth referred to as LSB, designate the position within each interval. The interpolation process takes place by forming the average and this is done by 16 additions in which the 8-bit word of the particular interval involved, and that of the next higher interval, are added in a weighting ratio which depends on the position of the input magnitude in the particular interval. Subsequently, the result is divided by 16. As an example, let it be assumed that the intermediate memory 14 (throttle valve position $\alpha$) contains the 5-bit word 01011 and the final count memory 21 contains the 5-bit word 01010. In that case, these two words select the square which is shown shaded and the computer circuit which follows the read-only memory must finally supply information corresponding to this particular square. The interpolation process is performed in linear manner, i.e., such that the stored 8-bit words, which are to be added in the 16 addition processes from 4 numerical values in this present example, are used as addends depending on their distance from the finite region defined by the two input values, i.e., the closer they are, the more often they occur as addends.

In the representation of FIG. 4, the 7 intervals are defined by the values $Y_1$ through $Y_8$ and $X_1$ through $X_8$, respectively, so that during the average value formation in the exemplary emdodiment shown, the following 8-bit words must be added: $X_3Y_3$; $X_4Y_3$; $X_3Y_4$ and $X_4Y_4$. In order to determine how often each of these particular 8-bit words is to be added, one may proceed as follows: Starting with the shaded square, one proceeds 4 interpolation steps in the X and Y directions and draws a square, as is shown by the thick border in FIG. 4. This square is then being sub-divided by the axes $X_4$ and $Y_4$, thereby forming 2 boxes within the 8-bit word $X_3Y_3$ and another 2 boxes in the 8-bit word $X_4Y_3$, 6 boxes in the 8-bit word $X_3Y_4$ and another 6 boxes in the square representing the 8-bit word $Y_4X_4$. This suggests the following addition process $2 \times X_3Y_3$, $2 \times X_4Y_3$, $6 \times X_3Y_4$ and $6 \times X_4Y_4$. This final result is then divided by 16 and corresponds to the average. Returning now to the representation of FIGS. 3 and 5. The address preselector 23, shown in FIG. 3, preselects the 8-bit words required for the subsequent 16 additions. Thus, the addressing in the read-only memory 22 is merely a decoding process. The additions are performed serially by the computer circuit 24 connected behind the read-only memory 22. The result is a word with a maximum of 12 bits of which only the first 8 MSBs are transferred, which implies a division by 16. The converter 26, connected behind the arithmetic unit 24, performs the conversion of this number into a required output value, preferably into a time period which can be applied to a servo member, for example the time can be the injection period $t_i$ for the fuel injection valves of the engine. In order to correcty time all the numerical events taking place, there is present a universal control circuit 27 which appropriately initiates the digital processes in the different circuits and this control circuit 27 is clocked by the overall system clock.

Figure 5:
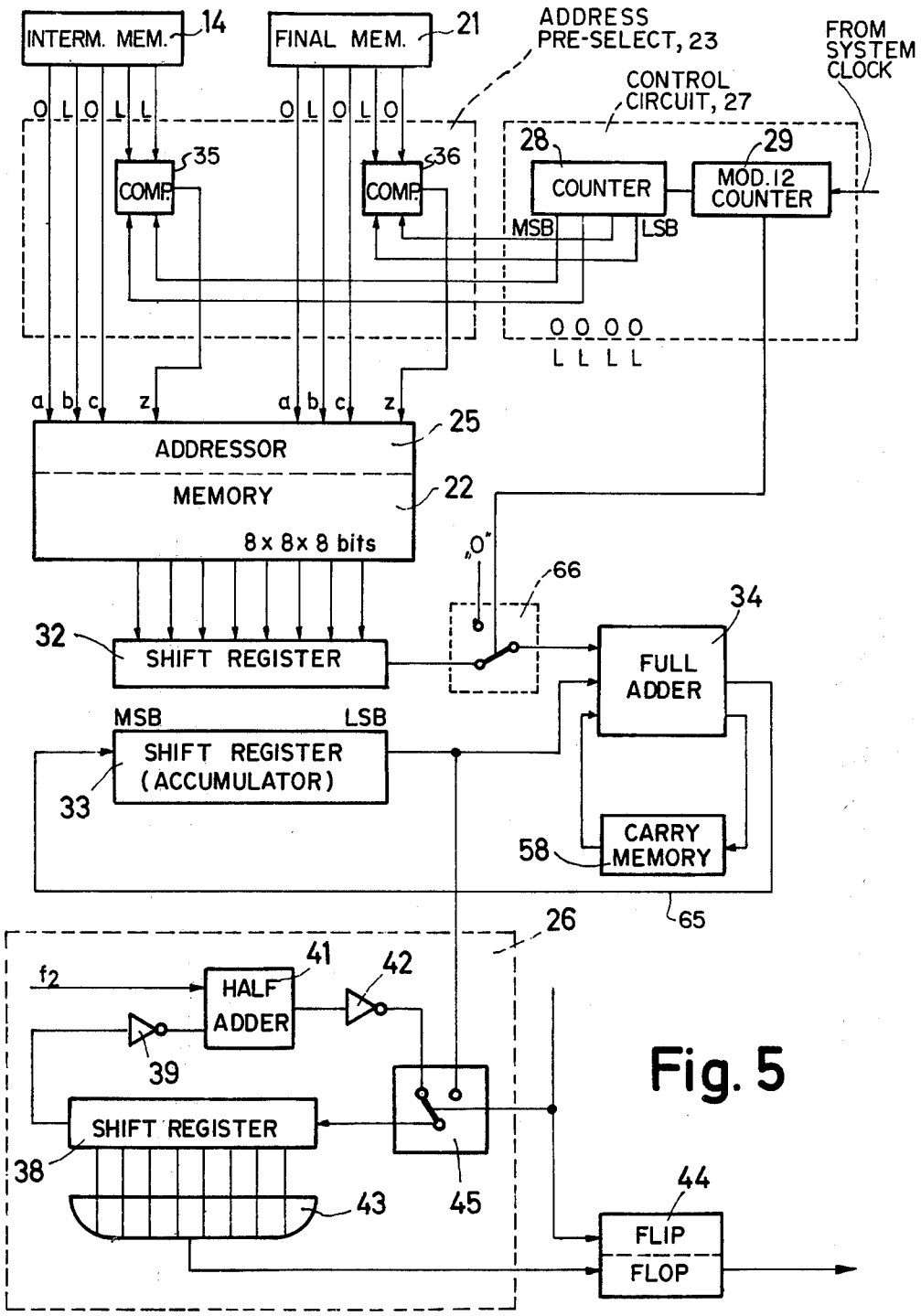
FIG. 5 is a detailed schematic diagram of a part of the apparatus shown in FIG. 3.
Figure 6:
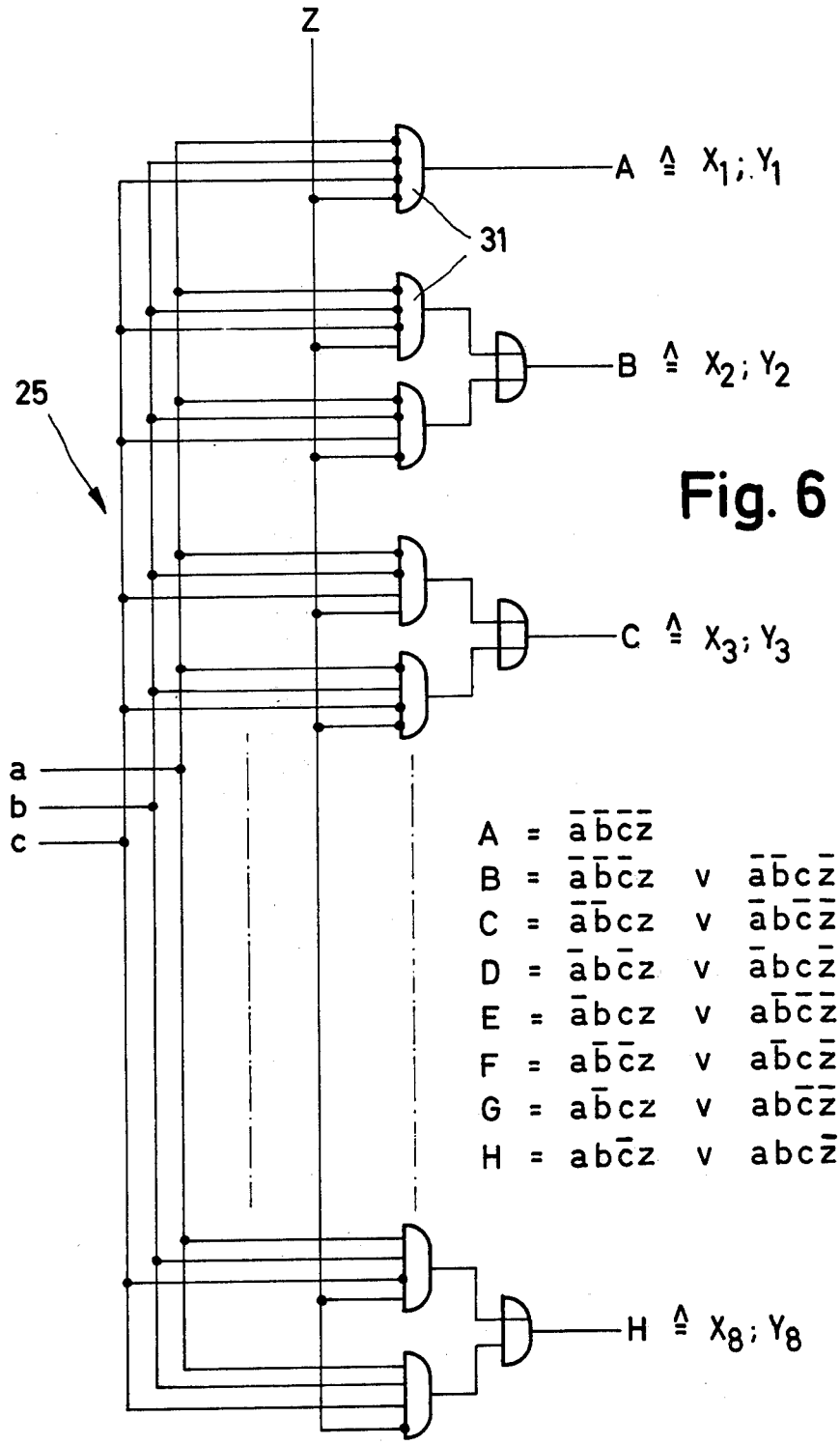
FIG. 6 is a schematic diagram of one embodiment of an addressing circuit for the memory in FIG. 4.

As is shown in greater detail in FIG. 5, the following takes place. The three most significant bits of each 5-bit word contained in the intermediate memory 14 and the final count memory 21 are directly used for addressing the read-only memory 22 and they are referred to as bits *a,b,c.* Thus these three first bits, *a,b,c,* in each direction X and Y, select the initial 8-bit word. The last 2 bits of each 5-bit word then determine the frequency with which this 8-bit word and the 3 adjacent 8-bit words are used in the addition process, as was described above. For this purpose, the last 2 bits of each 5-bit word from the intermediate memory 14 and the final count memory 21 are fed to comparators 35 and 36, respectively. The other inputs of the comparators are connected to the outputs of a counter 28. This counter 28 is part of the control circuit 27, which also contains a further counter 29 which uses the central system clock to provide 12 clock pulses required for serial addition. The counter 28 is connected behind the modulo 12 counter 29 and thus counts each 12th pulse. Thus, the 4-bit output word at the counter 28 changes from 0000 to 1111. Whenever 12 clock pulses, sensed by the counter 29, have occurred, one of the serial additions is completed and a new addition takes place, and, at the same time, the 4-bit counter 28 changes its output by 1. The two most significant bits from the counter 28 are fed to the comparator 35 and the two LSBs to the comparator 36. The output of these comparators is a signal Z. Whenever the 2-bit words from the counter 28 are equal to or larger than the two LSBs from the memories 14 and 21, then Z = 1, otherwise Z = 0. Thus, the comparators 35 and 36 perform a greater-than-or-equal test and the comparator 36 performs 4 additions in the X direction in each case (compare FIG. 4). Thus, as long as the 2 LSBs or the last 2 bits of the counter 28 are smaller than the 2 LSBs in the final count memory 21, the output signal Z of the comparator is 0. In that case, the 8-bit word associated with that interval (defined by the 3 MSBs *a,b,c* of the input word) is selected. However, if the counter content is equal or greater, then the output signal of the comparator 36, as well as that of the comparator 35 which acts in identical manner, is 1 and the 8-bit word of the next higher interval is selected. The comparator 35 controls the Y direction in exactly the same manner, but, due to the presence of the counter 28, it does so in a ratio of 4:1. An exemplary embodiment of the method of addressing the read-only memory 22 is shown in FIG. 6. Before proceeding with an explanation of the further processing of the 8-bit words which takes place in the circuit connected behind the ROM 22, it is useful to briefly explain the address selection used for the ROM with the aid of FIG. 6. FIG. 6 shows a schematic diagram of an address system in the Y or X direction wherein the 3 MSBs *a,b,c* are fed directly to AND gates 31; inputs having a black dot are negating inputs. The Z signal from the comparators is fed to a 4th input of each AND gate 31. If all inputs of the first AND gate on the top of the page are 0, i.e., if all of the values in the truth table of FIG. 6 are negative, then the word A is preselected which corresponds to the value $X_1$ or $Y_1$ since the scheme shown in FIG. 6 could refer to either direction. It is easily seen that, when the Z signal is a logical 1, the next higher 8-bit word B is selected, which would correspond to $X_2$ and $Y_2$.

Since the counter 28 is a 4-bit counter, this process selects 18, 8-bit words from the memory 22 and they are delivered to a shift registor 32 connected behind the ROM 22, as shown in FIG. 5. This shift register 32, as well as a further shift register 33 acting as an accumulator, are a part of the arithmetic unit 24 and are suitably so embodied that the 16 additions may be performed. Thus, the shift register 32 has an 8-bit capacity while the shift register 33 has a 12-bit capacity as required after 16 additions, and their outputs are connected to the inputs of a 1-bit full adder 34 whose output, in turn, is connected through a line 65 to the accumulator or shift register 33. Each addition occurs at the appropriate system clock pulse. A switch 66 is provided which pulls the output of the shift register 32 or the appropriate input of the full adder 34 to the value 0 after the first 8 clock pulses, i.e., after the 8 bits contained in the first shift register 32 have entered the accumulator 33 after passing through the full adder. This is done so that the last 4 bits in the shift register 33 which may be present there can be processed. The full adder 34 serially adds 1 bit out of the shift register 32 and the accumulator 33 and thus also requires an intermediate memory 58 for the carry. If necessary, however, and depending on the method of functioning of the shift register 32, the switch 66 may be eliminated; for example, if the register 32 has itself a capacity of 12 bits in which the 4 MSBs are 0.

After 16 additions have been performed, the accumulator 33 contains a 12-bit word which is divided by 16 by suppressing the 4 LSBs and transferring only the 8 MSBs. The transfer takes place through a line 37 at system clock rate and is thus controlled by the control circuit 27. The circuit also contains a gate in the line 37 for suppressing the 4 LSBs. The resulting 8-bit word, which represents a precise interpolation, is fed to a further shift register 38 embodied as a down-counter. The down-counter 38 has a capacity of 8 bits; its output is fed through an inverter 39 to the input of a half adder 41 whose other input is supplied with a clock frequency $f_2$ at the appropriate time. The output of the half adder is fed to a further inverter 42 back to the input of the down-counter 38. It will be appreciated that, by the first inversion, the addition of a single bit with the aid of the supply frequency $f_2$ and the second inversion, the content of the down-counter or the shift register 38 is counted out and the duration of the count-down is a measure of the magnitude of the original 8-bit word. A gate 43 associated with the down-counter 38 recognizes when the content of the down-counter 38 is 0 and delivers a signal which may be supplied, for example, to a subsequent flip-flop 44. This flip-flop may be set at the beginning of the down-counting process and thus a time-dependent measure is obtained which is proportional to the original magnitude of the 8-bit word contained in the down-counter 38. The setting may be performed by means of a crankshaft transducer which switches a switch 45 after the 8-bit word has been transferred from the accumulator 33 into the down-counter 38, so that the down-counter 38 counts to 0 and at the same time, the bistable flip-flop 44 is set. The flip-flop 44 is reset by the signal from the 0-sensing gate 43.

The foregoing illustrates that, in this manner, a set of characteristic curves specific to an internal combustion engine may be stored in digital fashion for any type of engine. Furthermore, this set of characteristic curves may also be read out without excessive expense and difficulty. Naturally, it is possible to adapt the number of bits of each word to the required precision, just as it is possible to change the number of bits of the words stored in the read-only memory.

Finally, FIG. 7 illustrates an improved possibility for counting down the period, i.e., related to the circuit elements 16,17,18,19 and 21 in FIG. 3 which provide a 5-bit word in the final count memory 21 representative of the period of crankshaft rotation. It is well known that the count-down process of the period at a constant frequency is very precise for low r.p.m. (i.e., for a large period) but becomes progressively less precise at higher and higher r.p.m. where the duration decreases. This disadvantage can be prevented, however, by replacing the up-counter 19 by a down-counter 50 and to conduct the count-down not at constant frequency, but at a variable frequency which approximates a hyperbolic function. For this purpose, there is associated with the down-counter 50 an interval decoder 51 which determines the actual duration of the period of rotation and transfers a corresponding signal to a frequency synthesizer 52. The synthesizer 52 generates a synthetic frequency from various non-coincident partial frequencies and feeds it to the down-counter. For this purpose, there is provided a counter divider 54 clocked by the main system clock and a circuit 53 which generates a multitude of non-coincident partial frequencies. These frequencies are supplied to the frequency synthesizer 52 for transmission to the down-counter 50. At the end of the period, a number which is proportional to the r.p.m. is taken over into the final count memory 21. In the present case, the approximation of the frequency to a hyperbolic function can be preferably very coarse so that the circuit shown in FIG. 7 may be relatively simple. For example, the hyperbolic frequency behavior may be approximated by two straight lines, thus requiring only two partial frequencies.

The digital circuit described heretofore makes it possible to influence the engine operation in many and various ways as required, for example, during warm-up, cold starting, and the like. Thus, for example, the normally constant frequency supplied to the down-counter 38 in the converter 26 can be changed by a multiplicative engagement. For example, a warm-running phase may be provided in which, within predetermined temperature regions, the frequency $f_2$ used for the count-down of the content in the down-counter is changed. The change of the frequency $f_2$ may also be used to transmit influences due to the feedback of smooth running signals or λ signals, as has been suggested schematically in FIG. 1. The control circuits used for building an overall control system can be so embodied that they normally supply a digital 0 or 1 signal, depending on whether a nominal value is exceeded or not. Such a signal permits changing the frequency $f_2$ in either direction so that the duration of the injection pulses may thus be directly influenced. For example, it is possible to use the 0 and 1 signals from the control circuits to control an integrator circuit which generates the frequency $f_2$ in the appropriate manner.

What is claimed is:

1. In an apparatus for controlling the operation of an internal combustion engine including determination of the fuel injection quantity, said internal combustion engine including cylinders defining combustion chambers and injection valves for injecting fuel into said combustion chambers, said fuel being injected in dependence on throttle valve position and engine r.p.m. and being controlled by controlling the injection duration of said fuel injection valves on the basis of characteristic engine data, said apparatus including a system clock for providing master timing signals and a digital arithmetic circuit including a read-only memory in which said characteristic engine data is stored, first transducer means for providing a first digital datum corresponding to throttle valve position and second transducer means for providing a second digital datum corresponding to engine r.p.m., means for feeding the most significant bits (MSB) of the instantaneous values of said first and second digital datum to said read-only memory thereby selecting a digital word contained in said read-only memory, the improvement comprising:

said digital arithmetic circuit includes a shift register connected behind said read-only memory, for adding selected data from said read-only memory and for transmitting it in serial bit form to a subsequent accumulator circuit, and further includes a 1-bit full adder circuit the input of which is connected to the outputs of said shift register and said accumulator and the output of which is connected to the input of said accumulator; whereby said digital arithmetic circuit performs the generation of a weighted average of a number of said digital words from said read-only memory.

2. An apparatus as defined by claim 1, wherein said 1-bit full adder includes an intermediate memory for the formation of the carry datum.

3. An apparatus as defined by claim 1, further comprising a down counter (shift register) connected to receive the preferably 12-bit content of said accumulator and to drop the 4 least significant bits, thereby performing a division by the factor 16.

4. An apparatus as defined by claim 3, further comprising means for counting down said down counter at a constant frequency during a period of time defined by the magnitude of the datum stored therein.

5. An apparatus as defined by claim 4, further comprising an inverter connected to the output of said down counter and a half adder connected behind said inverter, said half adder receiving a pulse train of arbitrary frequency (*f2*) and the output from said half adder being connected to a further inverter to the input of said down counter; whereby the content of said down counter may be counted down to 0.

6. An apparatus as defined by claim 4, further comprising a gate associated with said down counter for generating a signal when the content of said down counter is 0.

7. An apparatus as defined by claim 4, further comprising a flip-flop circuit connected to said second transducer means for defining the onset of counting in said down counter, said flip-flop circuit being connected to be reset by said gate; whereby the action of said flip-flop defines said period of time which is related to the length of fuel injection pulses for said internal combustion engine.

8. An apparatus as defined by claim 4, further comprising means for altering said frequency supplied to said down counter in dependence on engine variables and engine status; whereby the length of the fuel injection control pulses may be altered in multiplicative manner.

9. An apparatus as defined by claim 8, wherein said means for altering said frequency include means for generating signals based on engine roughness and the air factor λ which are delivered to said half adder; whereby said half adder and said down counter perform the function of a D/A converter.

10. An apparatus as defined by claim 9, wherein said frequency (*f*2) which is fed to said half adder in said D/A converter is generated by a circuit which receives feedback signals from said apparatus.

11. An apparatus as defined by claim 1, wherein said second transducer means is a sensor which cooperates with a marker on the crankshaft of said internal combustion engine and which supplies a signal related to crankshaft period to a second down counter and wherein said apparatus further comprises a frequency synthesizing circuit for providing to said second down counter a signal of variable frequency.

12. An apparatus as defined by claim 11, further comprising a counter-divider for generating a plurality of non-coincident partial frequencies which are fed to said frequency synthesizing circuit and further comprising an interval decoder for interrogating said second down counter and for controlling said frequency synthesizing circuit; whereby the counting frequency is adapted to a hyperbolic function of the period of crankshaft rotation.

13. An apparatus as defined by claim 1, further comprising an address preselector circuit connected ahead of said read-only memory and including a plurality of 4-input AND gates for receiving the most significant bits of the 5-bit words constituting said first and second digital datum and also for receiving an output signal from comparators which compare the least significant bits of said first and second digital datum with the content of a counter.

* * * * *